US011262142B2

(12) United States Patent
Touma, Jr.

(10) Patent No.: US 11,262,142 B2
(45) Date of Patent: Mar. 1, 2022

(54) HEAT EXCHANGERS, WELD CONFIGURATIONS FOR HEAT EXCHANGERS AND RELATED SYSTEMS AND METHODS

(71) Applicant: Northrop Grumman Systems Corporation, Falls Church, VA (US)

(72) Inventor: Michael J. Touma, Jr., Palm Beach Gardens, FL (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 911 days.

(21) Appl. No.: 15/139,233

(22) Filed: Apr. 26, 2016

(65) Prior Publication Data

US 2017/0307307 A1 Oct. 26, 2017

(51) Int. Cl.
*F28F 9/26* (2006.01)

(52) U.S. Cl.
CPC ..... *F28F 9/26* (2013.01)

(58) Field of Classification Search
CPC .... F28F 9/26; F28F 9/262; F28F 9/264; F28F 9/266; F28F 9/268; F28F 9/0278; F28F 7/02
USPC ..... 165/76
See application file for complete search history.

(56) References Cited

U.S. PATENT DOCUMENTS 2,357,251 A 8/1944 Behr
2,717,489 A 9/1955 Hasbrouck
2,792,200 A * 5/1957 Huggins ..... F28F 3/025 165/149
2,887,304 A * 5/1959 Hilliard ..... F28F 7/02 165/165
3,250,322 A * 5/1966 McCrary, Jr. ..... C04B 41/87 165/133
3,282,052 A 11/1966 Lagelbauer
3,289,757 A * 12/1966 Rutledge ..... F25J 3/04412 165/166
3,315,739 A * 4/1967 Kearney ..... F28F 7/02 165/165
3,347,059 A * 10/1967 Laing ..... F28D 11/02 62/325
3,385,353 A * 5/1968 Straniti ..... F28D 9/0012 165/67
3,424,240 A * 1/1969 Stein ..... F02C 7/08 165/166
3,785,435 A * 1/1974 Stein ..... F02C 7/08 165/166

(Continued)

FOREIGN PATENT DOCUMENTS

EP 530181 A1 3/1993
EP 0545842 A1 6/1993

(Continued)

*Primary Examiner* — Tho V Duong
*Assistant Examiner* — Raheena R Malik
(74) *Attorney, Agent, or Firm* — TraskBritt

(57) ABSTRACT

Heat exchangers include a first heat exchange section joined to a second heat exchange section. In some embodiments, channels of one or more of the heat exchange sections may be positioned such that adjacent channels are collinear in at least one direction. In some embodiments, sidewalls of one or more of the heat exchange sections may exhibit a substantially constant thickness along a section of the heat exchanger that includes the channels.

27 Claims, 4 Drawing Sheets

(56) References Cited

U.S. PATENT DOCUMENTS 3,983,933 A 10/1976 Fletcher et al.
4,044,825 A * 8/1977 Gugenberger ..... F28F 7/02 165/165
4,431,050 A * 2/1984 Martin ..... F02C 7/08 165/166
4,438,809 A * 3/1984 Papis ..... F28D 9/0018 165/166
4,470,454 A * 9/1984 Laughlin ..... F28D 9/0012 165/166
4,742,866 A * 5/1988 Yamanaka ..... F16N 39/02 165/167
4,836,276 A * 6/1989 Yamanaka ..... F01M 5/002 123/41.33
4,850,426 A * 7/1989 Fayolle ..... F28F 21/02 165/111
4,934,454 A * 6/1990 Vandyke ..... F28D 9/0006 165/164
5,050,668 A * 9/1991 Peterson ..... F02C 7/08 165/166
5,051,559 A 9/1991 Wells
5,060,721 A 10/1991 Darragh
5,078,206 A * 1/1992 Goetz, Jr. ..... F28D 1/0426 123/41.49
5,082,050 A * 1/1992 Darragh ..... F28D 9/0018 165/166
5,172,752 A * 12/1992 Goetz, Jr. ..... F28D 1/0426 123/41.49
5,371,945 A 12/1994 Schnoor
5,787,977 A * 8/1998 Yuasa ..... F28D 9/0012 165/165
5,878,590 A * 3/1999 Kadle ..... B60H 3/024 165/165
6,075,226 A 6/2000 Kishbaugh
6,099,373 A 8/2000 Fernstrum
6,368,060 B1 4/2002 Fehrenbach et al.
6,406,523 B1 * 6/2002 Connor ..... B01D 53/0431 96/125
6,438,936 B1 * 8/2002 Ryan ..... F02C 7/10 165/166
6,616,737 B1 * 9/2003 Evans ..... B01D 53/0415 96/135
6,692,556 B2 * 2/2004 Hayes ..... B01D 53/0415 210/282
6,715,293 B2 4/2004 Sillence et al.
6,764,279 B2 * 7/2004 Meshenky ..... F28D 7/1676 415/179
6,829,884 B2 12/2004 Fint et al.
6,988,540 B2 * 1/2006 Jensen ..... F28D 7/1669 165/134.1
6,998,570 B1 2/2006 Watkins et al.
7,127,908 B2 * 10/2006 Flaugher ..... B01D 53/0415 62/271
7,172,016 B2 * 2/2007 Meshenky ..... F02B 29/0462 165/125
7,178,345 B2 * 2/2007 Sobel ..... F17C 13/006 165/154
7,228,890 B2 6/2007 Guillaume
7,278,472 B2 * 10/2007 Meshenky ..... F02B 29/0462 123/563
7,337,834 B2 3/2008 Antonijevic et al.
7,395,669 B2 7/2008 Sherwood
7,614,161 B2 * 11/2009 Haurie ..... F26B 13/183 162/359.1
7,861,510 B1 1/2011 Wilson, Jr. et al.
8,806,747 B2 8/2014 Guinan et al.
9,046,063 B2 6/2015 Landgraf et al.
9,108,282 B2 8/2015 Guinan et al.
9,273,632 B2 3/2016 Ueda
9,513,059 B2 * 12/2016 Maurer ..... F28D 7/0058
10,041,747 B2 * 8/2018 Hon ..... F28F 21/006
2003/0033801 A1 2/2003 Hinder et al.
2003/0182928 A1 10/2003 Sillence et al.
2007/0029369 A1 2/2007 Watkins et al.
2007/0107885 A1 5/2007 Guillaume
2010/0012303 A1 1/2010 Domen
2010/0326756 A1 12/2010 Landgraf et al.
2012/0096858 A1 4/2012 Augenblick et al.
2013/0292098 A1 * 11/2013 Jindou ..... F28D 1/05308 165/143
2014/0034740 A1 2/2014 Sand
2014/0238012 A1 8/2014 Miller
2015/0000865 A1 1/2015 Ueda
2015/0258644 A1 9/2015 Jordan et al.
2015/0267645 A1 9/2015 Ueda

FOREIGN PATENT DOCUMENTS

EP 530181 B1 6/1994
EP 962738 A2 12/1999
EP 1363013 A1 11/2003
EP 1655097 A1 5/2006
EP 1655097 B1 7/2008
EP 1363013 B1 10/2008
EP 2843213 A1 3/2015
EP 2096294 B1 7/2015
EP 2045445 B1 3/2016
GB 1254372 A 11/1971
GB 1419839 A 12/1975
JP 05506916 A 10/1993
WO 9119150 A1 12/1991
WO 2004053416 A1 6/2004
WO 2007073453 A2 6/2007
WO 2013048448 A1 4/2013
WO 2014044981 A1 3/2014
WO 2015111847 A1 7/2015

* cited by examiner

HEAT EXCHANGERS, WELD CONFIGURATIONS FOR HEAT EXCHANGERS AND RELATED SYSTEMS AND METHODS

TECHNICAL FIELD

Embodiments of the present disclosure relate to heat exchanges for transferring heat energy to and/or from a medium (e.g., a fluid). More particularly, embodiments of the present disclosure relate to heat exchangers having one or more sections that are joined together (e.g., by one or more welded joints) and related assemblies, systems, and methods.

BACKGROUND

Heat exchangers are utilized to transfer heat energy from and/or to an adjacent area. For example, a heat exchanger including heat exchange passages (e.g., cooling passages) may be utilized to transfer heat energy away from heat generating areas of a device to at least partially prevent the generation of heat energy from affecting the performance of the device. The passages are typically filled with a fluid (e.g., a gas and/or liquid) that flows through the passages providing a conduit for the heat. Some devices require close tolerance cooling passages extending along an elongated section of the device that are a challenge to manufacture. Such devices include metallic structures exposed to high heat flux such as a combustor (e.g., for an aircraft engine). In some types of combustors, the passages are required to be relatively small and positioned in close proximity to one another. Generally, these passages are formed as circular apertures in a heat-receiving wall, where each circular aperture is spaced apart from adjacent apertures by solid sections of the wall, which lack such apertures.

The overall length of the heat exchanger passages and the proximity of the passages may make conventional drilling along the length of the passages with a drill bit difficult, if not impossible. For example, the passages in aircraft combustors can be sixteen inches or longer. This length makes use of a conventional drill bit difficult because it is hard to keep the drill bit from penetrating a surface of an interior chamber and/or from drifting into another cooling passage.

Other methods of providing passages with such small diameters in close proximity include machining grooves into the heat exchanger by cutting through a sidewall of the part and then attaching a face sheet to the heat exchanger in order to cover the open grooves.

A typical method of attachment of the face sheet is by welding or brazing the face sheet to the part with the machined grooves. For example, one tier welding technique involves forming blind channels in each section of a device and welding those sections together at regions of each section lacking the channels. The blind channels of each section are then connected by machining a connecting channel between each blind channel through a sidewall of the section and then covering the connection channels with a face sheet.

However, these techniques have limitations. For example, when the combustor is cylindrical in shape and exhibits a relatively small diameter, it can be difficult to form the grooves in the part as well as attach the face sheet to the part. Moreover, it is difficult to make select shapes of passages, such as circular passages, when a face sheet must be employed to cover the open passages.

Another method used to achieve circular passages is by machining laterally-extending semicircular grooves in the ends of two or more parts to provide a uniform thickness at the grooves for welding. Heat exchangers formed by such methods are disclosed in U.S. Pat. No. 9,108,282, the disclosure of which is hereby incorporated herein in its entirety by this reference. In such a heat exchanger, each part includes heat exchange channels extending longitudinally through the part and in communication with the lateral semicircular grooves at the ends of each part. The two parts are then mated together at the semicircular grooves. However, this technique requires twice the machining, since the semicircular grooves are required to be formed in both parts.

BRIEF SUMMARY

In some embodiments, the present disclosure comprises a heat exchanger including a body having a longitudinal axis. The body includes a first heat exchange section comprising a first plurality of channels extending through a wall of the first heat exchange section in a direction substantially parallel to the longitudinal axis of the body. At least one channel of the first plurality of channels is positioned adjacent to another channel of the first plurality of channels such that a portion of the at least one channel and a portion of the another channel of the first plurality of channels are collinear in a direction transverse to the longitudinal axis of the body and to a lateral direction of the body. The body further includes a second plurality of channels extending through a wall of the second heat exchange section in a direction substantially parallel to the longitudinal axis of the body. An end of the second heat exchange section is joined to an end of the first heat exchange section. At least some channels of the first plurality of channels are each aligned and in communication with a respective channel of the second plurality of channels. At least one channel of the second plurality of channels is positioned adjacent to another channel of the second plurality of channels such that a portion of the at least one channel and a portion of the another channel of the second plurality of channels are collinear in the direction transverse to the longitudinal axis of the body and to the lateral direction of the body.

In further embodiments, the present disclosure comprises a heat exchanger including a body having a longitudinal axis. The body includes a first heat exchange section comprising a first plurality of channels extending through the first heat exchange section in a direction substantially along the longitudinal axis of the body. At least one channel of the first plurality of channels and an adjacent channel of the first plurality of channels are positioned to intersect a line extending in a direction transverse to the longitudinal axis of the body and to a lateral direction of the body. The body further includes a second heat exchange section comprising a second plurality of channels extending through the second heat exchange section in a direction substantially along the longitudinal axis of the body. An end of the second heat exchange section is joined to an end of the first heat exchange section. At least some channels of the first plurality of channels are each in communication with a respective channel of the second plurality of channels.

In yet further embodiments, the present disclosure comprises a heat exchanger including a first heat exchange section comprising a first plurality of channels extending through a sidewall of the first heat exchange section in a direction substantially along a longitudinal axis of the heat exchanger. A material thickness of the sidewall of the first heat exchange section excluding voids of the first plurality of channels is substantially constant along a lateral portion of the heat exchanger that includes the first plurality of channels. The heat exchanger further includes a second heat exchange section comprising a second plurality of channels extending through a sidewall of the second heat exchange section in a direction substantially along the longitudinal axis of the heat exchanger. An end of the second heat exchange section is abutted and joined to an end of the first heat exchange section. At least some channels of the first plurality of channels are each in communication with a respective channel of the second plurality of channels. A material thickness of the sidewall of the second heat exchange section excluding voids of the second plurality of channels is substantially constant along a lateral portion of the heat exchanger that includes the second plurality of channels.

DETAILED DESCRIPTION

Heat exchangers utilized to transfer heat energy to and/or from one or more structures and/or mediums (e.g., an adjacent structure and/or medium) are described, as are heat exchanger assemblies, systems, and methods of forming heat exchangers. In particular, heat exchangers (e.g., an elongated heat exchanger), or a section of a heat exchanger, having one or more sections that are joined (e.g., by one or more welded joints) are described, as are related assemblies, systems, and methods. In some embodiments, a heat exchanger may include one or more heat exchange sections where each section includes one or more heat exchanger channels extending through the heat exchange section (e.g., along a longitudinal axis or centerline of the heat exchange section). Each heat exchange section may be coupled (e.g., welded at a weld joint) to an adjacent heat exchange section. The weld joint may extend in a direction transverse to (e.g., extending across) the direction in which the heat exchanger channels extend through one or more of the heat exchange sections.

Such heat exchangers may be implemented in a variety of applications. For example, in aerospace structures (e.g., aerospace propulsion structures, such as, aircraft or spacecraft engine combustors, portions of rocket engines or boosters, etc.) and structures used in energy production (e.g., structures utilized in production, transportation, or refining of hydrocarbons, nuclear fuels, etc.).

As used herein, the term "substantially" utilized in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 80.0% met, at least 90.0% met, at least 95.0% met, at least 99.0% met, or even at least 99.9% met.

Figure 1:
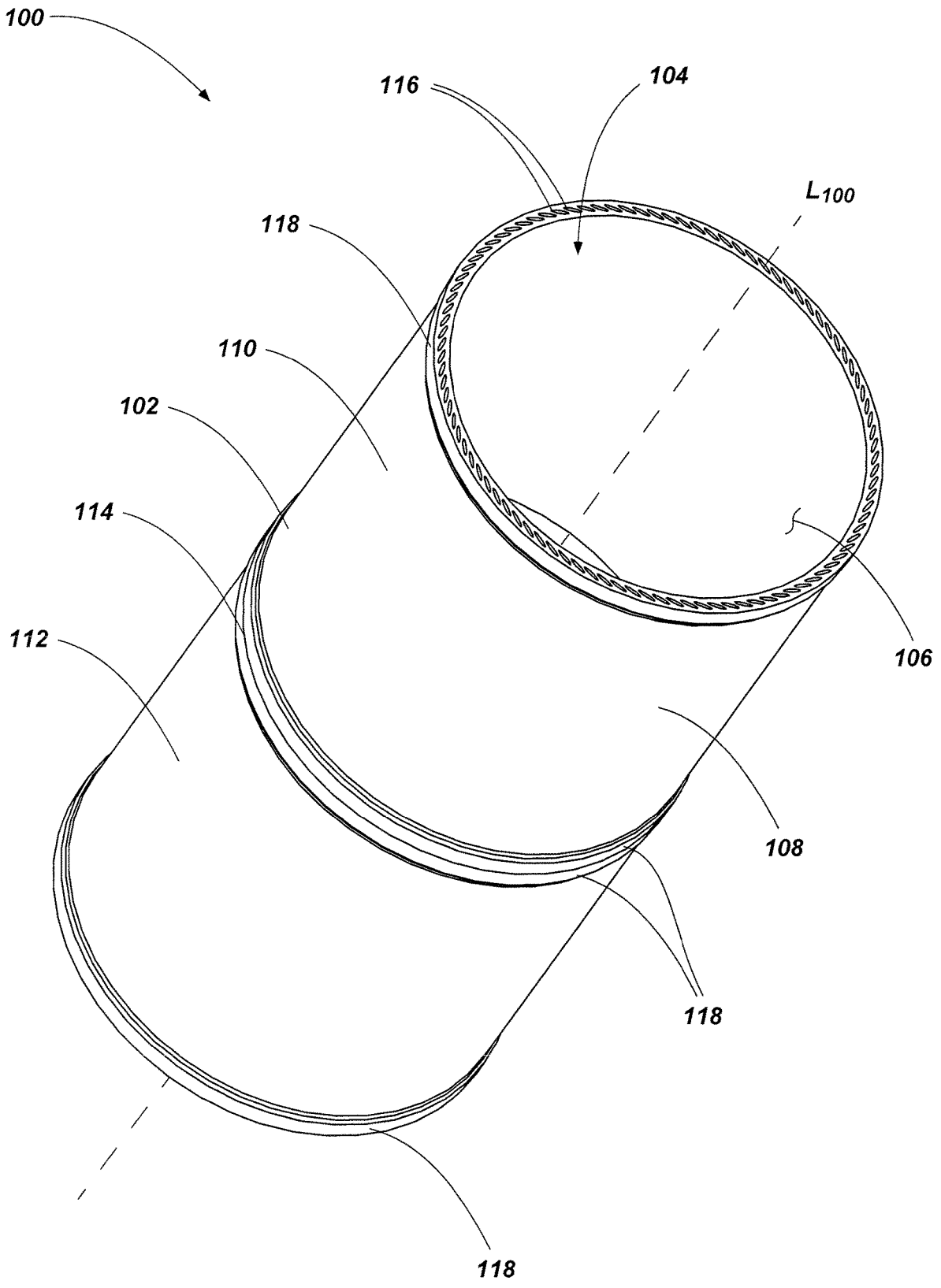
FIG. 1 is an isometric view of a heat exchanger in accordance with an embodiment of the present disclosure.

FIG. 1 shows an isometric view of an embodiment of a heat exchanger 100. Referring to FIG. 1, the heat exchanger 100 includes a body 102. As depicted, a cross-section of the body 102 may exhibit a substantially elliptical shape (e.g., a circular shape), which may particularly useful when the heat exchanger 100 is implemented in an aerospace engine structure. However, in other embodiments, the body 102 may exhibit any other suitable cross-sectional shape for a given application, such as, for example, a planar or polygonal shape (e.g., FIG. 6, discussed below), a curved or other nonlinear shape, or combinations thereof.

In embodiments where the body 102 exhibits a substantially elliptical cross-sectional shape, the body 102 of the heat exchanger 100 may define a passage 104 through which one or more matter (e.g., a medium, a fluid, a material including fluid with solids dispersed therein, an otherwise flowable material, etc.) may pass. The body 102 has an inner surface 106 surrounding and defining the passage 104 and an outer surface 108 opposing the inner surface 106 and the passage 104. In some embodiments, the inner surface 106 may be employed as a heat-absorbing surface that is configured to receive heat energy from the matter passing through the passage 104 (e.g., a fluid flowing through the passage 104). In additional embodiments, the outer surface 108 may be employed as a heat-absorbing surface that is configured to receive heat energy. For example, the outer surface 108 may act to transfer heat from a material outside of the body 102 and into the matter in the passage 104.

As depicted, the heat exchanger 100 includes one or more sections (e.g., first section 110 and second section 112) that are joined together longitudinally at an interface (e.g., a welded joint 114). Although two sections 110, 112 are depicted in FIG. 1, any number of sections may be implemented to define the heat exchanger 100.

In embodiments where a welded joint 114 is implemented, the welding process may comprise one or more of a fusion welding process (e.g., an electron-beam welding process (EBW), laser beam welding), a gas metal arc welding process (MIG), a gas tungsten arc welding process (TIG), and other types of welding.

The first and second sections 110, 112 of the heat exchanger 100 may each include a plurality of channels 116 extending through each section 110, 112. The channels 116 may be aligned along a length of the first and second sections 110, 112 of the heat exchanger 100. For example, the channels 116 may be aligned in a direction or arc that is substantially coextensive (e.g., nonintersecting or parallel) with a longitudinal axis $L_{100}$ (e.g., centerline) of the heat exchanger 100.

Depending on the application, the channels 116 may be configured to receive a liquid in the channels 116 in order to cool or heat matter adjacent to the channels 116 (e.g., a fluid flowing through the passage 104 of the body 102).

The welded joint 114 may extend in a direction transverse (e.g., extending across or substantially perpendicular) to the direction in which the channels 116 extend through the heat exchanger 100. For example, the channels 116 may extend in a direction at least partially along the longitudinal axis $L_{100}$ of the heat exchanger 100. In some embodiments, the channels 116 may extend in a direction substantially parallel to the longitudinal axis $L_{100}$. In some embodiments, the welded joint 114 may extend in a direction transverse to (e.g., perpendicular to) the longitudinal axis $L_{100}$ of the heat exchanger 100.

The welded joint 114 may extend through at least a majority (e.g., an entirety) of the body 102 of the heat exchanger 100 in one direction (e.g., in the direction transverse to the direction in which the channels 116 extend through the heat exchanger 100). For example, the welded joint 114 may extend from the outer surface 108 to the inner surface 106 of the heat exchanger 100. Such a configuration may maximize the amount of material of sections 110, 112 coupled together (e.g., maximize the surface area being coupled) at the welded joint 114 to enhance the overall strength of the welded joint 114.

In some embodiments, the channels 116 may extend around a circumference of the body 102 and each channel 116 may be equally circumferentially spaced relative to one or more adjacent channels 116.

The plurality of channels 116 extending through each section 110, 112 may be defined in the section 110, 112 prior to the sections 110, 112 being joined to define the body 102 of the heat exchanger 100. For example, the plurality of channels 116 may be preformed in each section 110, 112 prior to welding to another section 110, 112. In some embodiments, the plurality of channels 116 may be formed in each section 110, 112 through one or more processes, such as, for example, a drilling process, a milling process, a casting process, a wire electrical discharge machine (EDM) process, additive manufacturing, combinations thereof, or any other suitable process.

As discussed in further detail below, the shape and spacing of the channels 116 may enable the sections 110, 112 of the heat exchanger 100 to be joined (e.g., welded) while still maintaining the integrity of the channels 116, which have been formed (e.g., preformed) through the sections 110, 112. For example, the channels 116 of the sections 110, 112 of the heat exchanger 100 may extend from one end of the section 110, 112 to another opposing end of the section 110, 112, through an entirety of a depth of the section 110, 112 prior to the sections 110, 112 being joined together and the shape and spacing of the channels 116 may enable joining of the sections 110, 112 without causing significant damage to the channels 116 (e.g., minimal to no decrease in the functionality of the channels 116) during the joining process.

In some embodiments, the sections 110, 112 of the heat exchanger 100 may include radially extending, raised or lip portions 118 on either side or end (e.g., sides or ends positioned along the longitudinal axis $L_{100}$ of the heat exchanger 100) of the sections 110, 112. For example, the lip portions 118 may have a thickness (e.g., a radial thickness) that is greater than an adjacent portion of the body 102. In such an embodiment, the relatively thicker lip portions 118 may provide a larger surface area of each section 110, 112 in order to enhance the connection of one section 110, 112 of the heat exchanger 100 to adjacent sections 110, 112 of the heat exchanger 100.

Figure 2:
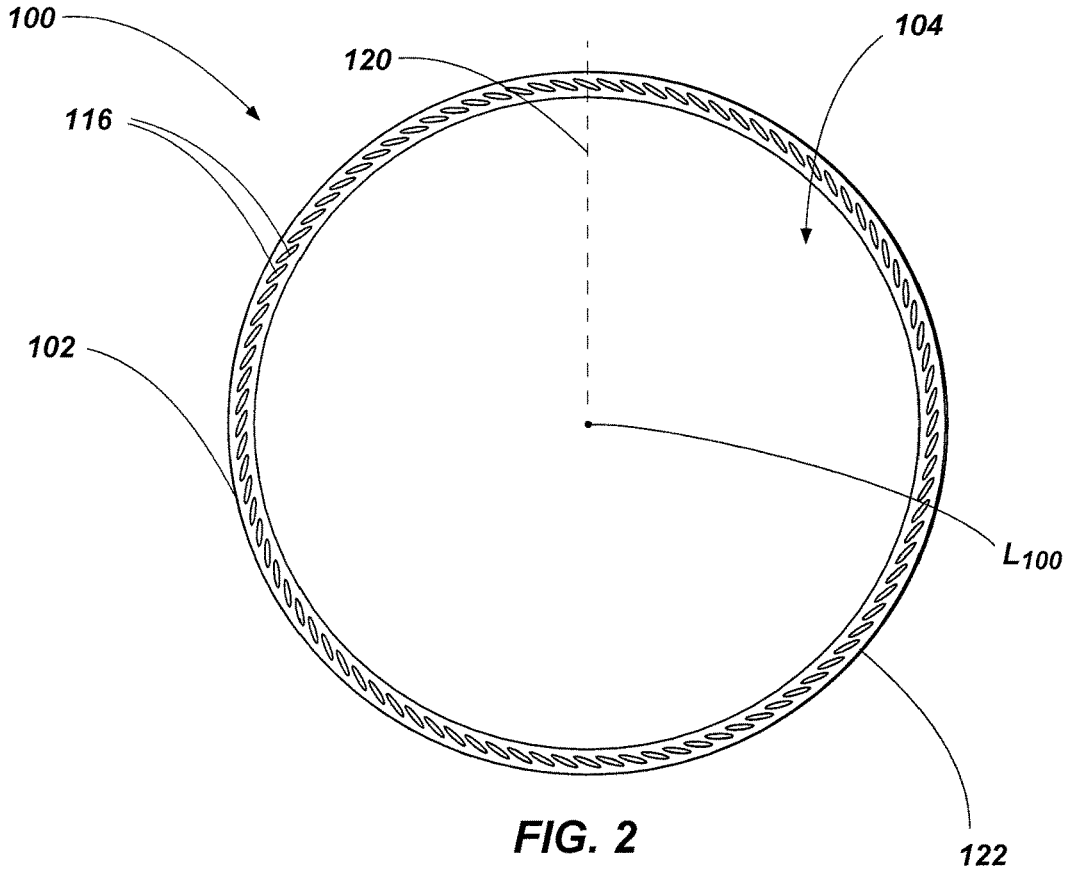
FIG. 2 is an end view of the heat exchanger of FIG. 1 showing the plurality of channels in the circular heat exchanger.
Figure 3:
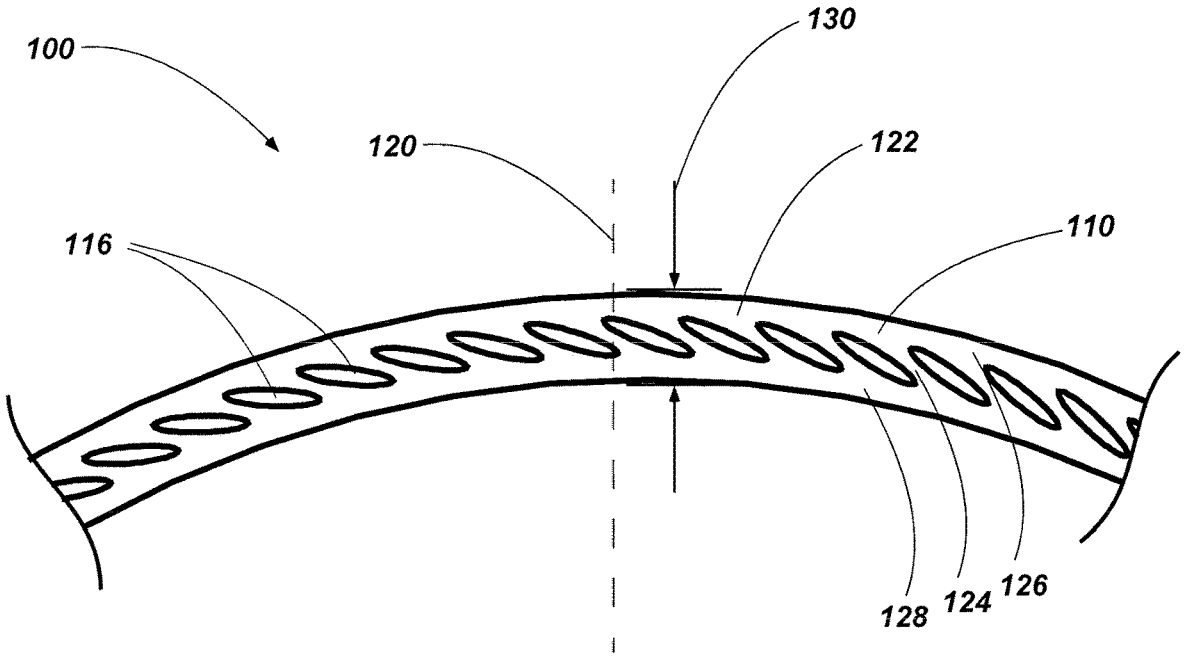
FIG. 3 is an enlarged end view of a portion of the heat exchanger of FIGS. 1 and 2 showing the plurality of channels in the circular heat exchanger.

FIG. 2 is an end view of the heat exchanger 100 of FIG. 1 showing the plurality of channels 116 in the circular heat exchanger 100 and FIG. 3 is an enlarged end view of a portion of the heat exchanger 100 showing the plurality of channels 116 in the circular heat exchanger 100. Referring to FIGS. 1 through 3, each of the channels 116 may be positioned such that the channels 116 are at least adjacent to or bordering (e.g., at least partially overlapping) one another in one or more directions transverse (e.g., perpendicular) to the longitudinal axis $L_{100}$ of the heat exchanger 100 (e.g., radial and circumferential directions). For example, the channels 116, oriented and extending along the circumference of the heat exchanger 100, are at least partially overlapped (e.g., along the circumference of the body 102) such that any cross section of the heat exchanger 100 in a section of the heat exchanger 100 including the channels 116 that is taken perpendicular to the longitudinal axis $L_{100}$ of the heat exchanger 100 will intersect one or more channels 116 in the body 102 (e.g., sidewall 122 of the body 102) of the heat exchanger 100. Stated another way, any cross section of the heat exchanger 100 in a section of the heat exchanger 100 including the channels 116 that is taken perpendicular to the longitudinal axis $L_{100}$ of the heat exchanger 100 will not intersect a portion of the sidewall 122 that lacks a channel 116 extending through the sidewall 122 (e.g., a section including only uninterrupted material that defines the sidewall 122). For example, as shown in FIG. 3, any radial axis (e.g., radial reference line 120) that extends outward from a central portion of the heat exchanger 100 (e.g., the longitudinal axis $L_{100}$ of the heat exchanger 100) will intersect one or two channels 116 of the heat exchanger 100.

Stated in yet another way, the channels 116 are positioned along a length of the sidewall 122 (e.g., the circumference of the heat exchanger 100) such that at least a portion of one channel 116 is collinear with at least a portion of an adjacent channel 116. For example, a portion of one channel 116 and a portion of an adjacent channel 116 are collinear (e.g., each channel 116 has at least one point on the same straight line) in a direction transverse to the longitudinal axis $L_{100}$ of the heat exchanger 100 and to the length of the sidewall 122 (e.g., where the length of the sidewall 122 extends along the channels 116).

As further shown in FIG. 3, the sidewall 122 of the heat exchanger 100 may include a middle portion, which may be characterized as webbing 124 of the sidewall 122 extending between an outer portion 126 and an inner portion 128 of the sidewall 122 that separates each of the channels 116. The channels 116 may be positioned such that a majority of the webbing 124 of the sidewall 122 extends in a direction that is oblique (e.g., not parallel or perpendicular) with respect to a radial axis of the heat exchanger 100 (e.g., radial reference line 120). In some embodiments, the channels 116 may be positioned such that a majority of the webbing 124 of the sidewall 122 extends in a direction (e.g., line or an arc) that is divergent (e.g., not coextensive) with the length (e.g., circumference) of the sidewall 122.

Such a configuration may provide the sidewall 122 with a substantially uniform cross-sectional material thickness 130 where the thickness of the voids defined by the channels 116 are excluded (e.g., subtracted from) cross-sectional material thickness 130. In other words, only the material forming the sidewall 122 (e.g., not the voids in the material) may exhibit a substantially uniform cross-sectional thickness 130 (e.g., where each cross section is within ±20%, 10%, 5%, 1%, or less (e.g., substantially 0%) of the remaining cross sections) where the thickness of the voids defined by the channels 116 is not included in the measurement of the actual material of the sidewall 122. For example, a cross-sectional thickness 130 of the material of the sidewall 122, where the thickness 130 taken in a radial direction and perpendicular to and at any location along the longitudinal axis $L_{100}$ of the heat exchanger 100 will intersect a void of at least one channel 116 and exhibit a thickness 130 that is substantially uniform with any other similar material thickness 130 taken in a radial direction and perpendicular to and at any location along the longitudinal axis $L_{100}$ of the heat exchanger 100 (e.g., the variation in each cross section is less than ±20%, 10%, 5%, 1%, or less as compared to cross sections taken in other portions of the sidewall 122).

As depicted in FIG. 3, the channels 116 may exhibit an elliptical, but non-circular, cross-sectional shape. For example, the channels 116 may each exhibit a cross-sectional shape of an elongated ellipse having a major axis and a minor axis, where the major axis is greater in length than the minor axis. The major axis of each channel 116 may extend in a direction transverse, but not perpendicular (e.g., at an oblique angle) to the thickness of the sidewall 122 of the heat exchanger 100. Such a configuration enables the elliptical channels 116 to be positioned substantially continuously along a lateral direction of the heat exchanger 100 that is transverse (e.g., perpendicular) to the longitudinal axis $L_{100}$ of the heat exchanger 100 (e.g., along the circumference of the heat exchanger 100). For example, the channels 116 are positioned along the circumference of the heat exchanger 100 such that one channel 116 begins at least at a location substantially where another channel 116 ends, without lateral sections of sidewall 122 that lack any channels 116 extending between the channels 116. In some embodiments, along the circumference of the heat exchanger 100, there are portions where at least two channels 116 will be intersected by a line extending in a radial direction from longitudinal axis $L_{100}$ of the heat exchanger 100.

Figure 4:
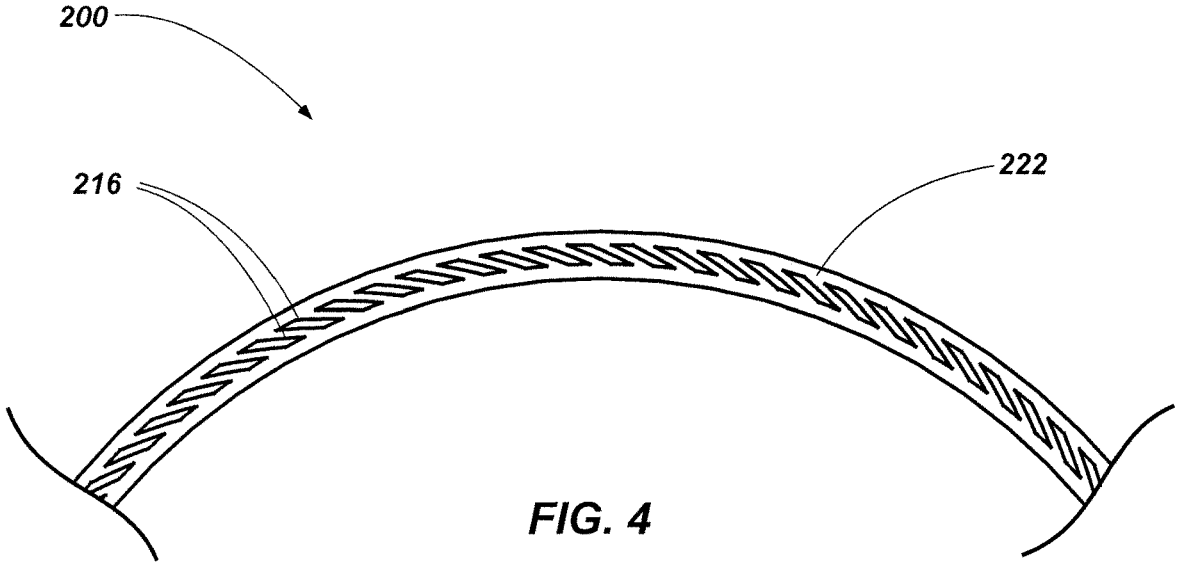
FIG. 4 is an enlarged end view of a portion of the circular heat exchanger showing a plurality of channels in the heat exchanger in accordance with an embodiment of the present disclosure.

FIG. 4 is an enlarged end view of a portion of a circular heat exchanger 200 showing a plurality of channels 216 in the heat exchanger 200 that may be similar and include the same or similar elements as the heat exchanger 100 discussed above. As shown in FIG. 4, the channels 216 may exhibit a polygonal cross-sectional shape (e.g., a quadrilateral cross-sectional shape having a major axis and a minor axis). For example, the channels 216 may each exhibit the cross-sectional shape of a parallelogram having a major axis and a minor axis, where the major axis is greater in length than the minor axis. The major axis of each channel 216 may extend in a direction transverse, but not perpendicular (e.g., at an oblique angle) to a thickness of a sidewall 222 of the heat exchanger 200. As above, such a configuration enables the parallelogram channels 216 to overlap along a lateral direction of the heat exchanger 200 that is perpendicular to a longitudinal axis of the heat exchanger 200 (e.g., along the circumference of the heat exchanger 200). In other words, along the circumference of the heat exchanger 200, there are portions where at least two channels 216 will reside intersected by a line extending in a radial direction from the longitudinal axis $L_{100}$ of the heat exchanger 200.

Figure 5:
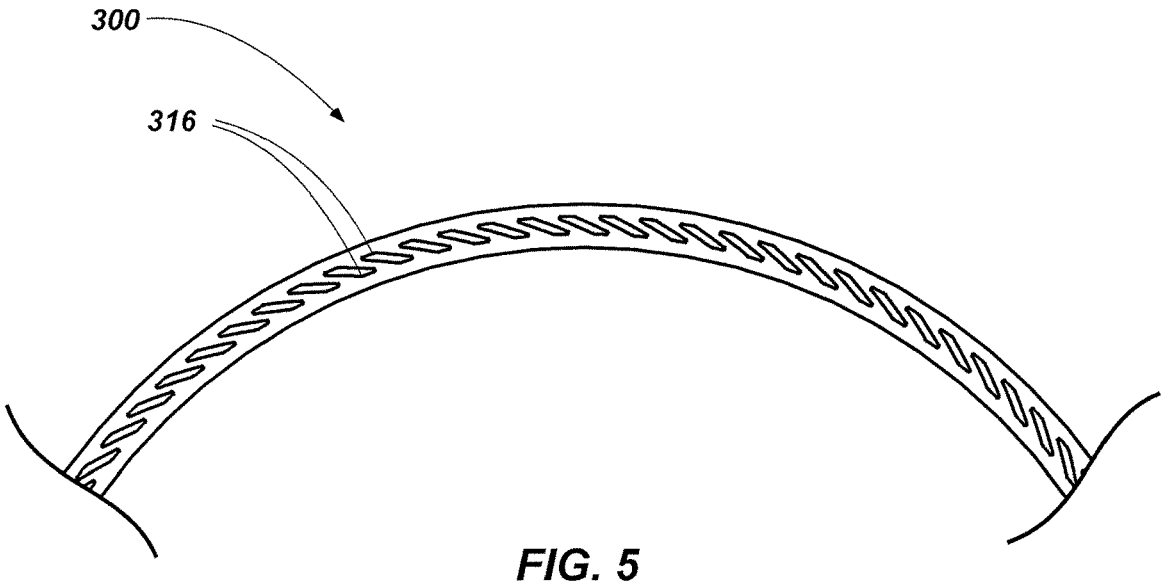
FIG. 5 is an enlarged end view of a portion of the circular heat exchanger showing a plurality of channels in the circular heat exchanger in accordance with an embodiment of the present disclosure.

FIG. 5 is an enlarged end view of a portion of a circular heat exchanger 300 showing a plurality of channels 316 in the heat exchanger 300 that may be similar and include the same or similar elements as the heat exchangers 100, 200 discussed above. As shown in FIG. 5, the channels 316 may exhibit a substantially polygonal cross-sectional shape (e.g., a quadrilateral cross-sectional shape having a major axis and a minor axis). However, the corners (e.g., four corners) of the quadrilateral channel 316 may be rounded or radiused. For example, the channels 316 may each exhibit the cross-sectional shape of a parallelogram having rounded or radiused corners and a major axis and a minor axis, where the major axis is greater in length than the minor axis.

Figure 6:
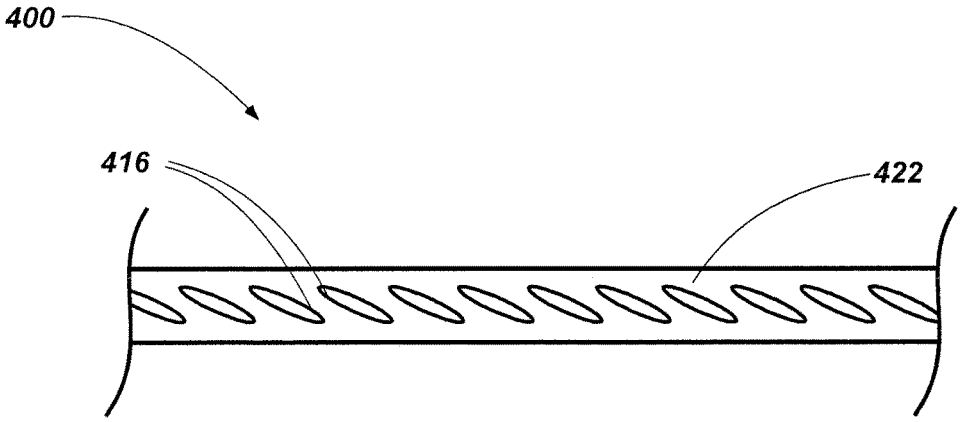
FIG. 6 is an enlarged end view of a portion of a planar heat exchanger showing a plurality of channels in the planar heat exchanger in accordance with an embodiment of the present disclosure.

FIG. 6 is an enlarged end view of a portion of a heat exchanger 400 showing a plurality of channels 416 in the heat exchanger 400 that may be similar and include the same or similar elements as the heat exchangers 100, 200, 300 discussed above. As shown in FIG. 6, the heat exchanger 400 may exhibit a planar or a linear configuration (e.g., as opposed to the circular heat exchangers 100, 200, 300 discussed above). As above, a major axis of each channel 416 (e.g., elliptical channels, quadrilateral channels, etc.) may extend in a direction transverse, but not perpendicular (e.g., at an oblique angle) to a thickness of a sidewall 422 of the heat exchanger 400. Such a configuration enables the channels 416 to overlap along a lateral direction of the heat exchanger 400 that is perpendicular to the longitudinal axis of the heat exchanger 400 (e.g., along a major length of the heat exchanger 400).

Figure 7:
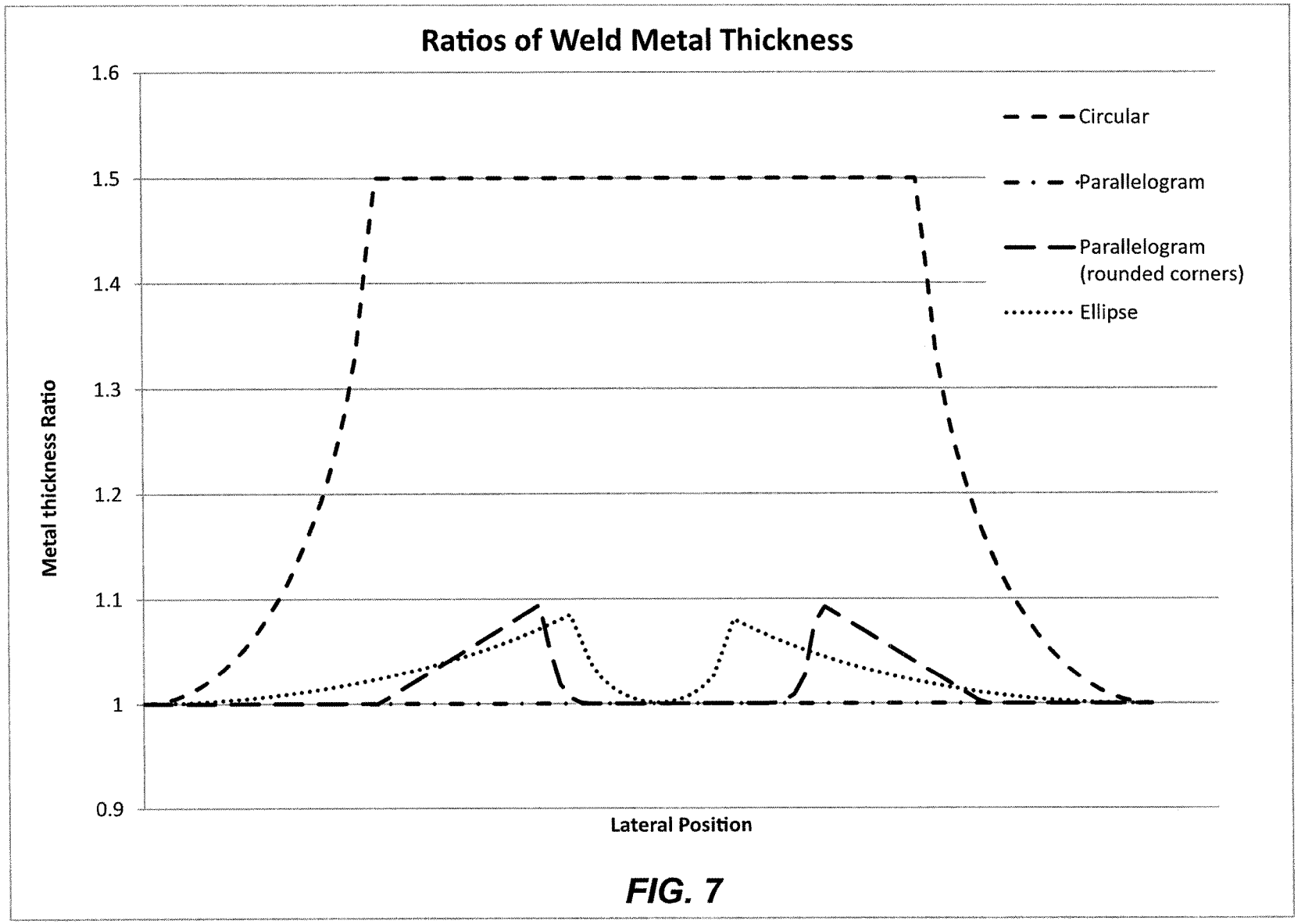
FIG. 7 is a graph illustrating the variation in wall thickness of heat exchangers in accordance with embodiments of the current disclosure as compared to a conventional heat exchanger having spaced circular channels.

FIG. 7 is a graph illustrating the variation in wall thickness of heat exchangers in accordance with embodiments of the instant disclosure as compared to a conventional heat exchanger having spaced circular channels. As shown in FIG. 7, the variation in wall thickness of a conventional heat exchanger including spaced-apart circular channels is compared to heat exchangers including parallelogram cross-sectional shaped channels (e.g., heat exchanger 200 shown in FIG. 4), parallelogram cross-sectional shaped channels with rounded corners (e.g., heat exchanger 300 shown in FIG. 5), and elliptical cross-sectional shaped channels (e.g., heat exchangers 100, 400 shown in FIGS. 1 through 3 and 6). The x-axis represents positions along a lateral direction of the heat exchanger (e.g., in a direction transverse to the length of the channels and perpendicular to a thickness of the sidewall where the panel is located) starting at a middle portion of one channel and ending at a middle portion of an adjacent channel. For example, in a conventional heat exchanger having spaced circular channels, the far left of the x-axis represents a lateral position where the central part of a circular channel is located, the middle portion of the x-axis represents a portion of the heat exchanger wall where no channel is located, and the far right of the x-axis represents a lateral position where the central part of another circular channel is located. For heat exchangers in accordance with embodiment of the instant disclosure lacking a portion where no channel is located, the far left of the x-axis represents a lateral position where the central part of a channel (e.g., an elliptical or parallelogram cross-sectional shaped channel) is located and the far right of the x-axis represents a lateral position where the central part of another channel is located.

As shown in the graph, the wall thickness, which includes only the portion of the wall formed by a material while excluding the voids of the channels, of a conventional heat exchanger having spaced circular channels includes relatively large differences in wall thickness (excluding the voids of the circular channels) depending on lateral position (e.g., up to a 1.5 times or ±35% difference between the respective wall thicknesses) between the portion of the wall (e.g., sidewall) including circular channels and adjacent portions lacking the circular channels that are positioned between the spaced-apart circular channels. The graph further illustrates that heat exchangers having overlapping channels, in accordance with embodiments of the instant disclosure, exhibit significantly lower amounts of variation in sidewall thickness. For example, heat exchangers having the elliptical cross-sectional channels or parallelogram cross-sectional shaped channels with rounded corners exhibit relatively smaller variations in wall thickness (excluding the voids of the channels) of less than a 1.1 times or less than ±10% difference in wall thicknesses depending on lateral position along the heat exchanger. Further, heat exchangers having the parallelogram cross-sectional shaped channels exhibit substantially no variation in wall thickness (excluding the voids of the channels) depending on lateral position along the heat exchanger.

Maintaining a substantially constant wall thickness (e.g., an average thickness of material defining the sidewall) enables relatively more efficient and reliable coupling of multiple heat exchange sections. For example, maintaining an average thickness of material defining the sidewall, with channels extending through the sidewall, enables sections of the heat exchanger to be welded together in an efficient and effective manner. In particular, in a welding process, such as, for example, an electron-beam welding process, the power of the beam is selected based on thickness of the material that is being welded together. In a conventional heat exchanger having spaced circular channels, the greatest thickness is generally selected to ensure that the weld joint extends through an entirety of the sidewall. However, as discussed above, in regions where the channels are located, the material thickness of the sidewall is significantly less (e.g., up to 35% less). Such a lower amount of material thickness in the sidewall is often not able to handle the higher power beam, resulting in damage to the sidewall and/or the channels in the sidewall (e.g., collapse of the sidewall).

Embodiments of the present disclosure may be particularly useful in providing heat exchangers having one or more sections that are joined (e.g., via a welding process) where heat exchange channels are defined in sections of the heat exchanger before the sections are joined together to form the heat exchanger (e.g., an elongated heat exchanger). In particular, the channels of each section of the heat exchanger may exhibit an overlapping configuration in at least one direction to provide a substantially consistent average sidewall material thickness. As discussed above, such a substantially consistent sidewall material thickness enables joining of the heat exchange sections (e.g., through a welding process, such as an electron beam weld) using a process that is selected based on the substantially consistent sidewall material thickness, without having to subject relatively less thick portions of the sidewall to processes that have been selected based on the relatively thicker portions of the sidewall. Such a configuration enables the formation of a joint (e.g., a weld joint) along the heat exchanger that spans a majority and/or an entirety of the width or thickness of the weld joint (e.g., from an inner portion of a sidewall, through a middle portion or webbing of a sidewall, and to an outer portion of a sidewall) without causing unacceptable damage or otherwise blocking the channels.

Further, utilizing the configurations and methods of embodiments of the instant disclosure enables the heat exchange channels to be isolated from one another throughout the length of the heat exchanger, as compared to the above-described techniques requiring semicircular grooves that place all of the channels in communication with one another. For example, as discussed above, heat exchangers including grooves formed in each end (such as those described in U.S. Pat. No. 9,108,282) place every channel in communication with the other channels at the laterally-extending grooves. However, embodiments of the instant disclosure remove the need for such groove, enabling the channels to remain isolated from one another. The weld joint may also surround each of the channels at the joint, reducing the chance of inadvertently placing one channel in communication with another channel through the welding process. Such mutually isolated channels may provide enhanced heat exchange in systems where a portion of the heat exchanger may be susceptible to relatively higher or lower temperatures (e.g., overheating). For example, such a configuration in a heat exchanger may act to isolate channels having overheated fluid enabling the other channels to still effectively transfer heat as the other channels are not in direct communication with the fluid from the overheated channels.

While particular embodiments of the disclosure have been shown and described, numerous variations and alternate embodiments encompassed by the present disclosure will occur to those skilled in the art. Accordingly, the disclosure is only limited in scope by the appended claims and their legal equivalents.

What is claimed is:

1. A heat exchanger for use in a combustor of an aircraft engine, the heat exchanger comprising:

a body having a longitudinal axis, the body comprising:

a first heat exchange section comprising a first plurality of channels extending continuously through a wall of the first heat exchange section in a direction along the longitudinal axis of the body, wherein at least one channel of the first plurality of channels is positioned laterally adjacent and at least partially aligned along a circumference of the first heat exchange section to another channel of the first plurality of channels such that both a portion of the at least one channel and a portion of the another channel of the first plurality of channels overlap by being positioned on a line intersecting the longitudinal axis and extending in a direction transverse to the longitudinal axis of the body; and a second heat exchange section comprising a second plurality of channels extending continuously through a wall of the second heat exchange section in a direction along the longitudinal axis of the body; and an end of the second heat exchange section joined longitudinally to an end of the first heat exchange section, at least some channels of the second plurality of channels each being aligned, in communication, and abutted and sharing a common boundary with a respective channel of the first plurality of channels, wherein at least one channel of the second plurality of channels is positioned adjacent to another channel of the second plurality of channels such that both a portion of the at least one channel and a portion of the another channel of the second plurality of channels are positioned on another line extending in the direction transverse to the longitudinal axis of the body and transverse to a lateral direction of the body, the first heat exchange section having a length along the longitudinal axis of the body that is greater than a thickness of the first heat exchange section along the lateral direction of the body.

2. The heat exchanger of claim 1, wherein a material thickness of the wall of the first heat exchange section excluding voids of the first plurality of channels is substantially constant along a portion of the first heat exchange section that includes the first plurality of channels, and wherein a material thickness of the wall of the second heat exchange section excluding voids of the second plurality of channels is substantially constant along a portion of the second heat exchange section that includes the second plurality of channels.

3. The heat exchanger of claim 2, wherein the material thickness of the wall of the first heat exchange section and the material thickness of the wall of the second heat exchange section are within ±20% along a portion of the heat exchanger that includes the first plurality of channels and the second plurality of channels.

4. The heat exchanger of claim 1, wherein each channel of the first plurality of channels is in communication with a respective channel of the second plurality of channels.

5. The heat exchanger of claim 1, wherein the body exhibits a cross-sectional elliptical shape and the lateral direction of the body comprises a circumference of a sidewall of the body wherein the plurality of first channels and the plurality of second channels are located.

6. The heat exchanger of claim 5, wherein each channel of the first plurality of channels overlaps at least one adjacent channel of the first plurality of channels in a circumferential direction within the sidewall of the body, and wherein each channel of the second plurality of channels overlaps at least one adjacent channel of the second plurality of channels in the circumferential direction within the sidewall of the body.

7. The heat exchanger of claim 1, wherein the first plurality of channels and the second plurality of channels each exhibit a cross section comprising a major axis and a minor axis, the major axis being greater in length than the minor axis.

8. The heat exchanger of claim 7, wherein the major axis of each channel of the first plurality of channels and the second plurality of channels extends in a direction transverse to the lateral direction of the body and the thickness of the first heat exchange section along the lateral direction of the body.

9. The heat exchanger of claim 7, wherein a cross section of each channel of the first plurality of channels and the second plurality of channels exhibits a substantially parallelogram shape.

10. The heat exchanger of claim 7, wherein a cross section of each channel of the first plurality of channels and the second plurality of channels exhibits a substantially elliptical shape.

11. The heat exchanger of claim 1, further comprising a weld joint joining the first heat exchange section to the second heat exchange section, the weld joint extending from a first surface of the body on a first side of the first plurality of channels and the second plurality of channels, around a majority of an interface between the first plurality of channels and the second plurality of channels, and to a second surface of the body on a second, opposing side of the first plurality of channels and the second plurality of channels.

12. The heat exchanger of claim 1, wherein at least one of the first plurality of channels or the second plurality of channels extends in the direction along the longitudinal axis of the body at an offset angle relative to the longitudinal axis of the body.

13. An aircraft engine comprising a combustor including the heat exchanger of claim 1.

14. A heat exchanger, comprising:

a body having a longitudinal axis, the body comprising:

a first heat exchange section comprising a first plurality of channels extending through the first heat exchange section in a direction at least partially along the longitudinal axis of the body, wherein at least one channel of the first plurality of channels and an adjacent channel of the first plurality of channels are positioned to intersect a line extending in a direction transverse to and intersecting the longitudinal axis of the body, the first heat exchange section having a length along a longitudinal axis of the first heat exchange section that is greater than a thickness of the first heat exchange section along a lateral direction of the first heat exchange section;

a second heat exchange section comprising a second plurality of channels extending through the second heat exchange section, an end of the second heat exchange section having the second plurality of channels defined therein being joined to an end of the first heat exchange section having the first plurality of channels defined therein, at least some channels of the first plurality of channels each being in communication with a respective channel of the second plurality of channels; and a weld joint joining the first heat exchange section to the second heat exchange section, the weld joint extending around a majority of an interface between the first plurality of channels and the second plurality of channels at the end of the first heat exchange section and the end of the second heat exchange section.

15. The heat exchanger of claim 14, wherein at least one channel of the second plurality of channels and an adjacent channel of the second plurality of channels are positioned to intersect another line extending in the direction transverse to the longitudinal axis of the body and extending in the lateral direction of the body.

16. The heat exchanger of claim 15, wherein at least one channel of the first plurality of channels at least partially overlaps the adjacent channel of the first plurality of channels along the lateral direction of the body, and wherein the at least one channel of the second plurality of channels at least partially overlaps the adjacent channel of the second plurality of channels along the lateral direction of the body.

17. The heat exchanger of claim 14, wherein each channel of the first plurality of channels is in communication with a respective channel of the second plurality of channels.

18. The heat exchanger of claim 14, wherein the weld joint extends from a first surface of the body on a first side of the first plurality of channels and the second plurality of channels to a second surface of the body on a second, opposing side of the first plurality of channels and the second plurality of channels.

19. The heat exchanger of claim 14, wherein a void defined by at least one channel of the first plurality of channels exhibits a major axis and a minor axis, the major axis being greater in length than the minor axis.

20. The heat exchanger of claim 19, wherein the major axis of the void defined by the at least one channel of the first plurality of channels extends in a direction transverse to the lateral direction of the body.

21. The heat exchanger of claim 14, wherein at least two adjacent channels of the first plurality of channels and at least two adjacent channels of the second plurality of channels exhibit a substantially parallelogram cross-sectional shape or a substantially elliptical cross-sectional shape.

22. The heat exchanger of claim 14, wherein at least one of the first plurality of channels extends through the first heat exchange section or the second plurality of channels extends through the second heat exchange section at an oblique angle relative to the longitudinal axis of the body.

23. A heat exchanger, comprising:

a first heat exchange section comprising a first plurality of channels, at least some of the first plurality of channels partially overlapping an adjacent channel of the first plurality of channels, the first heat exchange section having a length along a longitudinal axis of the first heat exchange section that is greater than a thickness of the first heat exchange section in a radial direction of the first heat exchange section, each channel of the first plurality of channels extending along the length of the first heat exchange section within a sidewall of the first heat exchange section and parallel to the longitudinal axis of the first heat exchange section, the sidewall defining a circumference of the first heat exchange section; and a second heat exchange section comprising a second plurality of channels extending through the second heat exchange section, an end of the second heat exchange section being joined to an end of the first heat exchange section, each channel of the first plurality of channels being in communication with and sharing a common boundary with a respective channel of the second plurality of channels to define a plurality of continuous channels extending along a length of the heat exchanger, wherein each channel of the plurality of continuous channels is isolated from adjacent continuous channels of the plurality of continuous channels, the sidewall of the first heat exchange section having a substantially uniform material thickness in the radial direction, the material thickness defined by the material of the sidewall and excluding a thickness of voids defined by the continuous channels of the plurality of continuous channels.

24. The heat exchanger of claim 23, further comprising a weld joint between the end of the first heat exchange section and the end of the second heat exchange section.

25. The heat exchanger of claim 23, wherein each channel of the plurality of continuous channels is not in fluid communication with adjacent channels of the plurality of continuous channels.

26. The heat exchanger of claim 23, wherein each channel of the plurality of continuous channels extends along the length of the heat exchanger at an oblique angle relative to a longitudinal axis of the heat exchanger and at an oblique angle relative to the radial direction.

27. An aircraft engine comprising a combustor including the heat exchanger of claim 23.

* * * * *